US012589969B2

(12) United States Patent
Dixon et al.

(10) Patent No.: US 12,589,969 B2
(45) Date of Patent: Mar. 31, 2026

(54) SINGLE-USE CABLE PAYOFF SYSTEMS WITH REDUCED PULL RESISTANCE

(71) Applicant: Southwire Company, LLC, Carrollton, GA (US)

(72) Inventors: Mark D. Dixon, Carrollton, GA (US); John Armstrong, Villa Rica, GA (US); Steven Powers, Carrollton, GA (US); Stephen L. Spruell, Carrollton, GA (US); Randy D. Kummer, Villa Rica, GA (US); Torri L. Logan, Newnan, GA (US)

(73) Assignee: Southwire Company, LLC, Carrollton, GA (US)

( * ) Notice: Subject to any disclaimer, the term of this patent is extended or adjusted under 35 U.S.C. 154(b) by 402 days.

(21) Appl. No.: 17/402,434

(22) Filed: Aug. 13, 2021

(65) Prior Publication Data

US 2022/0144578 A1 May 12, 2022

Related U.S. Application Data

(60) Provisional application No. 63/111,936, filed on Nov. 10, 2020, provisional application No. 63/111,691, filed on Nov. 10, 2020.

(51) Int. Cl.

| | |
|---|---|
| ***B65H 49/28*** | (2006.01) |
| ***B65D 19/44*** | (2006.01) |
| ***B65D 85/04*** | (2006.01) |
| ***B65H 49/36*** | (2006.01) |

(52) U.S. Cl.

CPC ..... *B65H 49/28* (2013.01); *B65D 19/44* (2013.01); *B65D 85/04* (2013.01); *B65H 49/36* (2013.01); *B65D 2519/00815* (2013.01); *B65H 2402/52* (2013.01); *B65H 2408/24* (2013.01); *B65H 2601/25* (2013.01)

(58) Field of Classification Search

None

See application file for complete search history.

(56) References Cited

U.S. PATENT DOCUMENTS

| | | | | | |
|---|---|---|---|---|---|
| 2,424,413 | A | | 7/1947 | Nelson | |
| 2,554,615 | A | | 5/1951 | Dahle | |
| 2,580,129 | A | * | 12/1951 | Rich | A47F 13/04 242/129.8 |
| 2,965,331 | A | * | 12/1960 | Nagy | A47F 13/04 242/138 |
| 2,981,496 | A | * | 4/1961 | Harmon | B65H 49/26 242/129.8 |

(Continued)

FOREIGN PATENT DOCUMENTS

| | | | |
|---|---|---|---|
| CN | 102219130 | A | 10/2011 |
| CN | 106517018 | A | 3/2017 |
| WO | 200151395 | A1 | 7/2001 |

*Primary Examiner* — William A. Rivera

(74) *Attorney, Agent, or Firm* — Merchant & Gould P.C.

(57) ABSTRACT

Disclosed herein are disposable cable payoff systems that maintain the performance standards required for operation at commercial sites, such as durability during transport from the manufacturer and cable payoff, and low resistance cable payoff. Preloaded cable reels comprising a disposable cable payoff system are also disclosed herein. Methods for providing the preloaded cables reels are also disclosed herein.

20 Claims, 7 Drawing Sheets

(56) References Cited

U.S. PATENT DOCUMENTS

| | | | | | |
|---|---|---|---|---|---|
| 2,985,404 | A * | 5/1961 | Tashiro | B21C 47/18 | 242/128 |
| 3,041,006 | A * | 6/1962 | Eckert | B65D 85/04 | 242/128 |
| 3,464,647 | A * | 9/1969 | Jacobi | B65H 49/30 | 242/129 |
| 3,593,943 | A | 7/1971 | Collmann | | |
| 3,716,204 | A | 2/1973 | Klingbeil | | |
| 3,937,414 | A * | 2/1976 | Bank | B65H 49/38 | 242/129 |
| 3,974,980 | A | 8/1976 | Marcell | | |
| 4,015,795 | A * | 4/1977 | Chong | B65H 49/28 | 242/129 |
| 4,089,486 | A * | 5/1978 | Carter | B65H 49/28 | 242/129 |
| 4,184,647 | A * | 1/1980 | Rourke | B65H 49/30 | 242/396.9 |
| 4,190,214 | A | 2/1980 | Bond | | |
| 4,457,195 | A * | 7/1984 | Brooks | H02G 1/005 | 83/210 |
| 4,667,897 | A | 5/1987 | Burrow et al. | | |
| 4,953,810 | A * | 9/1990 | Stadig | B65H 49/28 | 242/129 |
| 4,973,011 | A * | 11/1990 | Wilson | B65H 49/28 | 242/129 |
| 5,078,332 | A | 1/1992 | Carter | | |
| 5,092,464 | A * | 3/1992 | Taylor | B65D 19/44 | 206/415 |
| 6,749,139 | B2 | 6/2004 | Speck | | |
| 9,522,804 | B1 * | 12/2016 | Hill | B65H 49/26 | |
| 9,796,556 | B1 * | 10/2017 | Hill | B65H 49/32 | |
| 9,908,738 | B1 * | 3/2018 | Tóth | B65H 49/305 | |
| 2002/0066822 | A1 * | 6/2002 | Emes | B65H 75/18 | 242/129 |
| 2006/0196988 | A1 * | 9/2006 | Kurzyniec | B65D 85/04 | 242/588.2 |
| 2009/0166235 | A1 * | 7/2009 | Mansson | B65D 85/672 | 206/391 |
| 2019/0211523 | A1 * | 7/2019 | Brewster, Jr. | B65H 49/305 | |
| 2019/0241353 | A1 * | 8/2019 | Reedy | B21C 47/22 | |

* cited by examiner

SINGLE-USE CABLE PAYOFF SYSTEMS WITH REDUCED PULL RESISTANCE

CROSS REFERENCE TO RELATED APPLICATIONS

This application is a non-provisional application which claims a benefit of priority to U.S. Provisional Application No. 63/111,691, filed Nov. 10, 2020, and to U.S. Provisional Application No. 63/111,936, filed Nov. 10, 2020, each of which are hereby incorporated herein by reference in their entirety.

BACKGROUND

Cable payoff systems are known for the purpose of dispensing cable to a customer or end user, for instance at a point of purchase or job site. Such payoff systems conventionally are constructed to withstand significant weight from the cable reel and cable while allowing an easy rotation of the cable reel to assist payoff. Thus, conventional cable payoff systems are fixed constructions of durable materials that represent significant expense, and therefore are not readily disposable or considered within a single-use cable reel packaging. In a conventional embodiment, payoff system components are constructed of steel such that the payoff system can be installed within a commercial bay and reloaded with a cable reel as the cable reel is exhausted of cable.

Conventional cable payoff systems therefore can require intermittent reloading of the cable payoff, which can be a significant source of injury and material loss. In particular, maneuvering the cable reel onto conventional payoff systems can require positioning a cable reel axle over a steel cylinder extending vertically from the payoff with little room for error. If, for instance, the cable reel and cylinder are not aligned when lowered, the cable reel can tilt and fall during the reloading step. The cable reel may also get hung and eventually fall into place resulting in an unrestricted dropping of several hundred pounds, with a significant potential for injury. Reloading operations as described above are performed at commercial venues where customers may be present or nearby.

Cable payoff systems that are able to avoid such maneuvering in commercial locations are desirable and expected to significantly reduce accidents, injuries, and damage at the commercial site.

SUMMARY

This summary is provided to introduce a selection of concepts in a simplified form that are further described below in the detailed description. This summary is not intended to identify required or essential features of the claimed subject matter. Nor is this summary intended to be used to limit the scope of the claimed subject matter.

It is a purpose of this disclosure to provide a disposable cable payoff system without sacrificing functional aspects of conventional cable payoff systems. It is also a purpose of the disclosure to provide a robust and durable cable payoff system from disposable materials, such that allow the cable payoff system to be provided in a single-use manner, and thereby allowing the disposable cable payoff system to be preloaded with a cable reel at a manufacturing site and packaged as a single-use cable reel payoff for commercial use.

Disclosed herein are disposable reel payoff systems comprising a support frame, a base plate, a central rotatable bearing having a lower portion secured to the support frame, and a second portion freely rotatable relative to the first portion, a plurality of peripheral bearings disposed within the support frame and positioned to contact and support the base plate, and a pintle secured within the support frame extending and extending through the base plate substantially perpendicular to the base plate. Payoff systems disclosed herein also can comprise a cable reel preloaded onto the base plate of the system, surrounding the pintle. Packaging systems disclosed herein as a single-use packaging comprising any payoff disclosed herein and a preloaded cable reel are also contemplated herein. Metal banding is also contemplated within the single-use packaging.

Also disclosed herein are methods of providing a cable payoff system within a commercial bay. Such methods can comprise loading a cable reel onto any disposable reel payoff system disclosed herein to provide a preloaded cable reel payoff system, and subsequently shipping the preloaded cable payoff system to the commercial site for direct installation within a commercial bay. Methods disclosed herein do not require on-site installation of the cable reel to the disposable reel payoff system. In certain aspects, the entire preloaded cable payoff system is configured to be discarded after the cable reel has been completely payed off the reel without unloading the cable reel from the disposable reel payoff system.

Both the foregoing summary and the following detailed description provide examples and are explanatory only. Accordingly, the foregoing summary and the following detailed description should not be considered to be restrictive. Further, features or variations may be provided in addition to those set forth herein. For example, certain aspects and embodiments may be directed to various feature combinations and sub-combinations described in the detailed description.

DEFINITIONS

Figure 1:
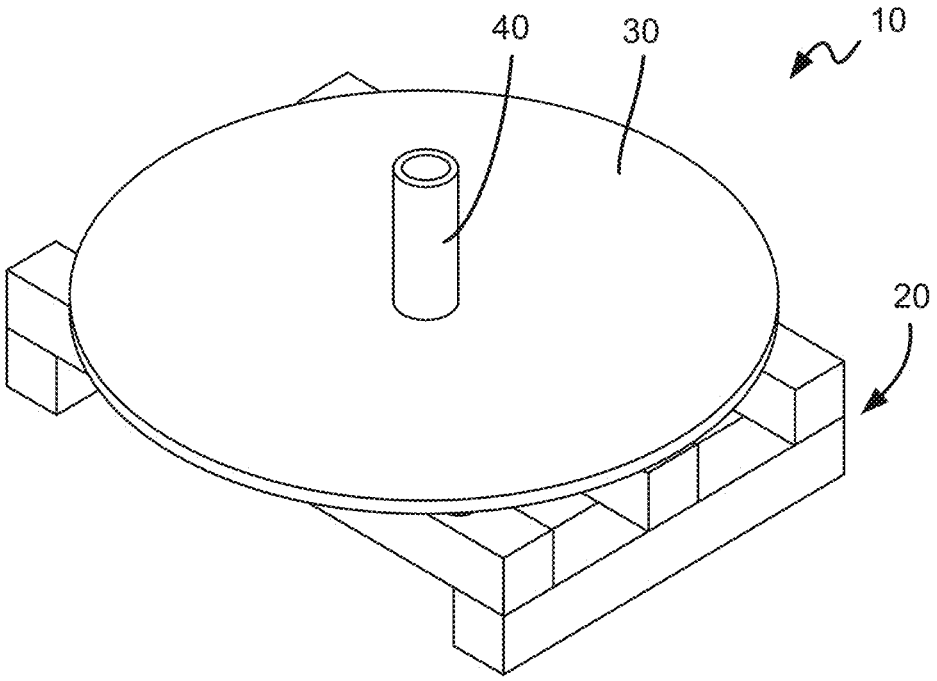
FIG. 1 depicts an embodiment of a disposable cable payoff of the present invention.

The phrase "a" or "an" entity as used herein refers to one or more of that entity. The terms "optional" or "optionally" as used herein means that a subsequently described element, event, or circumstance may but need not occur, and that the description includes instances where the event or circumstance occurs and instances in which it does not.

References to items in the singular should be understood to include items in the plural, and vice versa, unless explicitly stated otherwise or clear from the context. Grammatical conjunctions are intended to express any and all disjunctive and conjunctive combinations of conjoined clauses, sentences, words, and the like, unless otherwise stated or clear from the context. Thus, unless otherwise indicated or made clear from the context, the term "or" should generally be understood to mean "and/or" and, similarly, the term "and" should generally be understood to mean "and/or."

Recitation of ranges of values herein are not intended to be limiting, referring instead individually to any and all values falling within the range, unless otherwise indicated herein, and each separate value within such a range is incorporated into the specification as if it were individually recited herein.

The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the embodiments.

In the following description, it is understood that terms such as "first," "second," "third," "upper," "lower," "below," and the like, are words of convenience and are not to be construed as implying a positional or chronological order or otherwise limiting any corresponding element unless expressly stated otherwise.

For the purpose of this disclosure, the center of any component can refer to a two-dimensional or three-dimensional center. The term center may also refer to a center of mass of a given element. For instance, in certain aspects, the payoff system can comprise a pintle extending within the two dimensional center of the support frame that does not pass through the three dimensional center, by virtue of the pintle being positioned equidistant from each edge of the support frame, but only extending within an upper portion of the frame such that the pintle does not extend through the center of mass, or the three-dimensional center of the support frame.

DETAILED DESCRIPTION

The information that follows describes embodiments with reference to the accompanying figures, in which preferred embodiments are shown. The foregoing may, however, be embodied in many different forms and should not be construed as limited to the illustrated embodiments set forth herein.

The information that follows details various embodiments of the disclosure. For the avoidance of doubt, it is specifically intended that any particular feature(s) described individually in any one of these paragraphs (or part thereof) may be combined with one or more other features described in one or more of the remaining paragraphs (or part thereof). In other words, it is explicitly intended that the features described below individually in each paragraph (or part thereof) represent aspects of the disclosure that may be taken in isolation and/or combined with other aspects of the disclosure. The skilled person will appreciate that the claimed subject matter extends to such combinations of features and that these have not been recited in detail here in the interest of brevity.

Disposable cable payoff systems disclosed herein can generally comprise a support frame, a pintle extending perpendicular to a horizontal surface of the support frame, and a base plate configured to provide support to a flange of a cable reel. The base plate also can be configured to rotate relative to the support frame such that a cable reel loaded onto the pintle of the system can payoff a length of cable against a pulling force aligned at a single angular position relative to the payoff system, such that the pulling force and cable payoff can be maintained from a single position.

The construction of payoff systems disclosed herein is not limited to any particular material, and any materials that provide the device adequate durability, acceptable cost, and maintain disposability of the payoff system can be suitable. For instance, the payoff system can be constructed of recyclable materials, renewable resources, or a combination thereof. In certain embodiments, the payoff system can comprise wood, plastic, or both. In some aspects, payoff systems can comprise at least 75% wood, at least 80% wood, at least 90% wood, at least 95% wood. In certain aspects, the support frame can be constructed from a plurality of untreated wood supports fastened together by any suitable fasteners. Suitable fasteners can include screws or bolts, or alternatively plastic fasteners such as staples, clips, and the like.

Payoff systems can comprise a support frame suited to provide structural support to the payoff and cable reel during pay off of the cable. In certain aspects, the support frame can comprise two layers of supports, each layer comprising a plurality of lower supports and a plurality of upper supports respectively. Each upper support may be positioned perpendicular with respect to each lower support so as to allow maximum structural support with minimal construction weight. In certain aspects, each of the bearings, pintle, and base plate may contact the upper supports. Particularly, the pintle can be disposed within a vertical bore in a central upper support, wherein the bore does not traverse the support completely. In this manner, the pintle easily can be inserted and removed from within the bore restricting sliding of the cable reel relative to the support frame during payoff, and also allowing the system to be easily dismantled for disposal. Ease of dismantling the payoff system also can provide advantage to the separation of system elements for recycling. For instance, where the pintle is a PVC or plastic material, the pintle may be easily separated from other wood and metal components of the disposable system for recycling. Thus, the pintle can be provided within and restrained by the support frame without fasteners.

Similarly, the base plate can be constructed in any manner suitable to retain advantages of a disposable cable payoff system. In certain aspects, the base plate can be substantially circular so as to match the profile of a cable reel flange. The base plate also can be constructed of plywood or pressed board, having an actual thickness of at least 15/32 inches, ½ inches, ¾ inches, ⅞ inches, 1 inch, 1¼ inches, or 1½ inches. In certain aspects, the base plate can have a diameter (or greatest width where the base plate is not circular) of at least 12 inches, at least 24 inches, at least 36 inches, or at least 48 inches. Alternatively, the base plate can have a diameter (or greatest width) in a range from 12 to 48 inches or from 18 to 36 inches.

Rotation of the base plate relative to the support frame can be achieved by any suitable arrangement of bearings positioned throughout the support frame. For instance, the support frame can comprise a central bearing centered with respect to the pintle and axis of the cable reel. In certain aspects, the central bearing can have a first portion secured to the support frame, and a second portion freely rotatable relative to the first portion. In certain aspects, the central bearing can comprise a lazy susan bearing generally defined as having a plurality of bearings disposed within a ridge defining a substantially curved path defined between a first portion and a second portion of the lazy susan bearing, such that the first and second portion are able to rotate with respect to one another as the plurality of bearings moves within the ridge, and along the curved path. An example of a lazy susan bearing as disclosed herein is provided by FIG. 2. In certain aspects, the central bearing can have a fixed or variable height. For instance, where the central bearing is a lazy susan bearing as described above comprising a plurality of bearings within a ridge, the ridge may have some amount of space additional to the size of the bearings. Other examples of lazy susan bearings are contemplated herein as would be understood by those of skill in the art.

The support frame also can comprise a plurality of peripheral bearings disposed around the central bearing. In certain aspects, the support frame can comprise 2, 3, 4, 5, 6, 7, or 8 peripheral bearings. While not being bound by theory, it is believed that the positioning of the peripheral bearings can lead to the unexpected advantages in pulling force at least by optimally distributing weight of the cable reel among the bearings. For instance, in certain aspects, the peripheral bearings can be positioned within a concentric path, relative to the central bearing and the rotation of the support base. In such aspects, the support base can define a singular concentric path along a bottom surface of the support base which contacts the plurality of bearings, thereby limiting points of contact between the support base and the bearings. Limiting the contact in this manner can provide a support base with fewer weakened positions, and fewer positions that need conditioning for optimal pulling. Alternatively, the peripheral bearings can be arranged at variable distances from the central bearing such that several concentric contact paths are formed between a bottom surface of the support base and the plurality of peripheral bearings. In such aspects, the support base can be better suited for distributing the weight of the cable reel across radial portions of the support base.

Peripheral or central bearings as described herein are not limited to a particular type of bearing, and generally can be any element that allows for a low friction rotation between adjacent parts within the cable payoff. In this sense, it will be understood that reference to bearings disclosed herein may refer to ball bearings specifically, sliding rings, or any other low friction elements to accommodate rotation, particularly rotation of the base plate during pay off of the cable.

The plurality of peripheral bearings can be positioned on the surface of the support frame, or recessed within the support frame. Peripheral or central bearings as disclosed herein can be any low friction elements that provide a low friction rotation between elements attached to the bearing. Thus, in certain aspects, peripheral bearings can comprise a ball transfer bearing. In other aspects, peripheral bearings can be a pair of "slip rings" generally comprising two plates constructed of a material that allows for easy sliding between the plates (e.g., plastics and polymers, UHMW polyethylene). In this sense, adhesive furniture gliders may serve as a slip ring adhered to one surface and slidable against another adjacent surface. In other aspects, the peripheral and central bearings can comprise an inverted caster having a wheel facing and/or contacting a bottom surface of the base plate.

In aspects where peripheral bearings are recessed within the frame, or other aspects, the ball transfer bearings may be vertically aligned with a central rotatable bearing such that a top surface of the central rotatable bearing is substantially planar with respect to the top point of the ball transfer bearing. In this manner, the base plate can be supported by the plurality of peripheral bearings in a substantially horizontal manner. The central bearing may have a fixed or variable vertical position with respect to the support frame, and with respect to the peripheral bearings.

A concentric path formed between any of the plurality of peripheral bearings and the central bearing can have any radius that allows favorable distribution of weight of the cable reel and facilitates a cable payoff with low pulling resistance. In certain aspects, each or any of the peripheral bearings can be positioned a distance from the central bearing of at least 6 inches, 10 inches, 12 inches, 16 inches, 18 inches, or 24 inches. Alternatively, the distance between the central bearing and each or any of the peripheral bearings can be in a range from 6 inches to 24 inches, from 10 inches to 20 inches, or from 14 inches to 18 inches. In aspects where two or more concentric paths within the bottom surface are formed by peripheral bearings, the distance between first, second, third, etc. peripheral bearings and the central bearing can be the same or different, and within any range disclosed above. In such aspects, the concentric paths formed can be spaced evenly (e.g., every 6 inches, every 8 inches) or unevenly (e.g., a first concentric path at 6 inches, and a second concentric path at 18 inches), for any distance or range of distances disclosed above.

It is contemplated that in certain aspects, the base plate can be compressible on a bottom surface, and along the at least one concentric path formed by contact between the peripheral bearings and the base plate. In such aspects, the weight of the cable reel can cause compression along the concentric path on the bottom surface of the base plate, thereby forming a circular channel within the bottom surface. In certain aspects, the compression can occur within 2, 3, 4, or 10 revolutions of the cable reel. Certain aspects described herein can comprise preforming the channel prior to packaging, such that the packaged product comprises a channel in the base plate. In other aspects, the circular channel can have a depth no greater than 50% or 75% of the thickness of the base plate as disclosed above. Thus, in certain aspects, the channel can have a depth in a range from ⅛" to 1" or from ¼" to ¾", as the thickness of the base plate may allow. In other aspects, the channel depth can be at least ⅛", at least ¼", at least ⅜", at least ½", or at least ⅝". Compression of the base plate as described herein can result in a change in the load distribution, generally causing a relatively larger amount of the cable reel to be supported by the central bearing as the vertical position of the base plate is lower. Redistribution of weight toward the central bearing may be particularly seen where the central bearing comprises a variable height bearing. In certain aspects, the central bearing can support at least 40% of the weight of the cable reel.

As will be understood by those of skill in the art, compression of the base plate can be more prevalent, or to a greater extent, where heavier reels are employed, allowing the cable reel payoff to be advantageously employed across a range of cable reel weights, e.g., for reels weighing from 100 to 1500 lbs, from 250 to 1000 lbs, or from 300 to 800 lbs. Alternatively, certain aspects may operate without forming a depression within the base plate.

Figure 2:
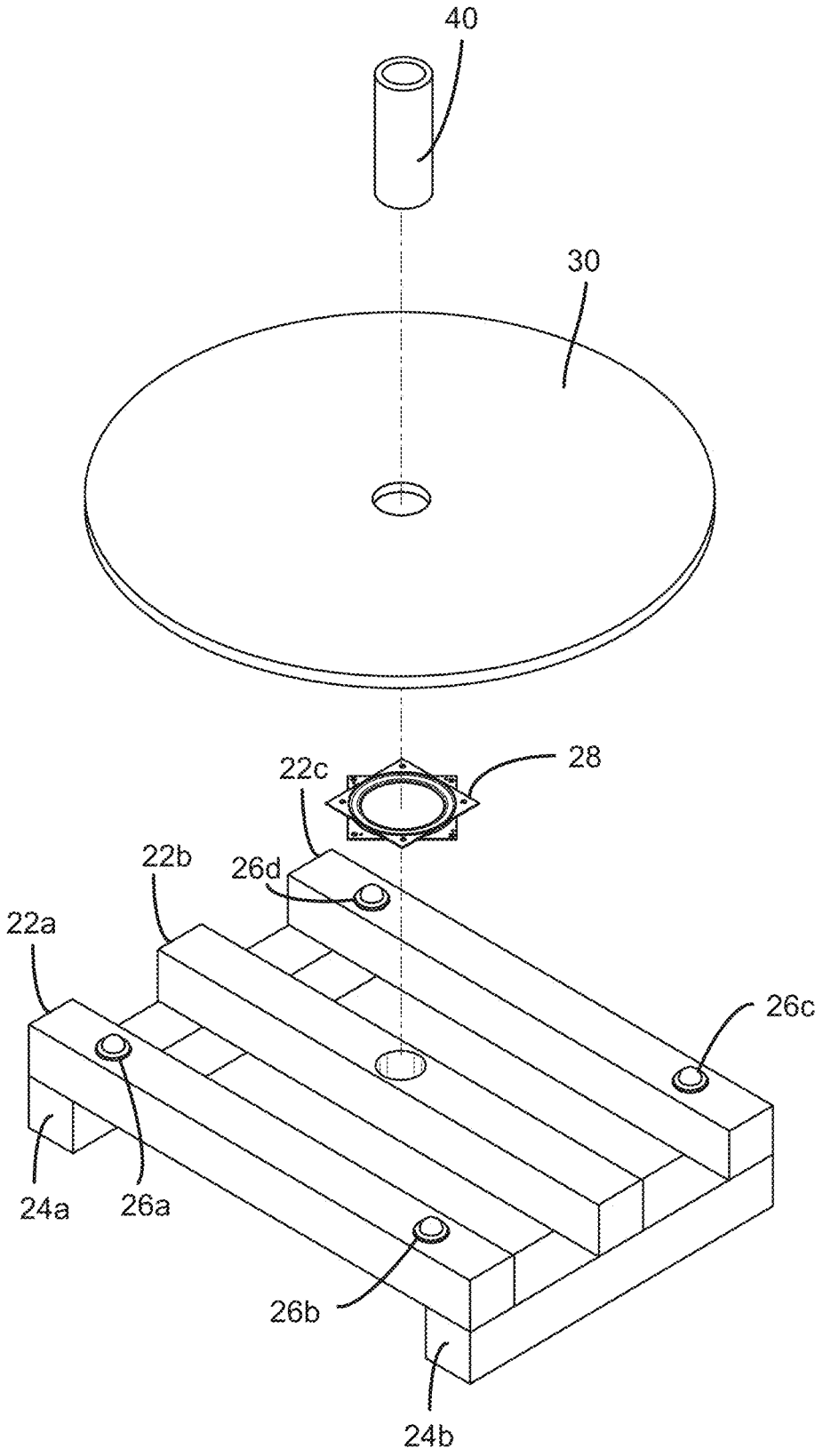
FIG. 2 depicts an exploded view of the disposable cable payoff of FIG. 1.

FIG. 1 represents an embodiment of the cable reel payoff system disclosed herein. As shown, cable reel payoff system 10 comprises a support frame 20, base plate 30, and pintle 40. The base plate is circular and constructed from ¾" plywood. Pintle 40 extends through a center hole in the base plate and into the support frame. As best shown in FIG. 2, the support frame 20 can comprise a top layer and bottom layer, each comprising a plurality of individual supports (22*a,b,c* and 24*a,b*, respectively). Top supports 22*a,b,c* each can independently comprise recesses to independently secure bearings or pintle 40 within support frame 20. Alternatively, the peripheral bearings 26*a-d* can be mounted directly to the surface frame 20, without recessing the bearings within the frame. Central bearing 28 is shown exploded from the support frame 20, but in practice can be substantially coplanar with peripheral bearings 26*a-d* and at their top surface in order to provide support to the base plate.

Figure 3:
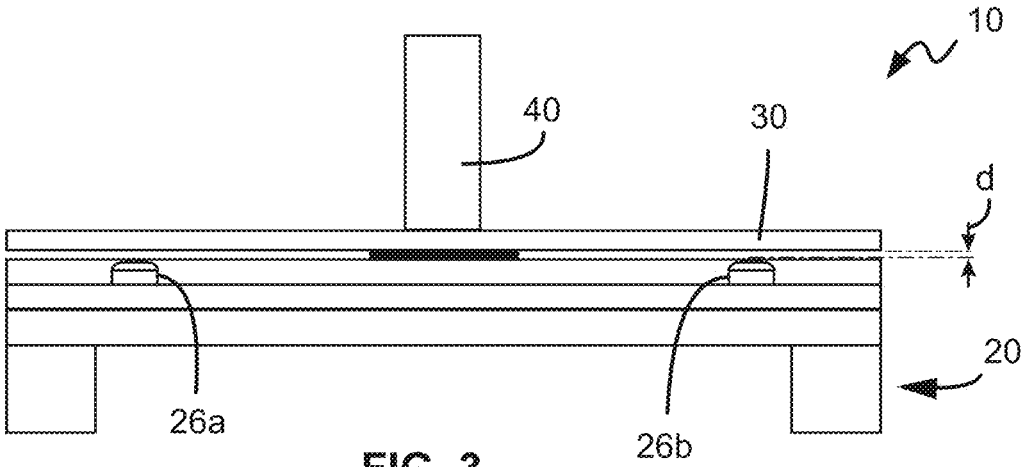
FIG. 3 depicts a side view of the disposable cable payoff of FIG. 1.

Alternatively, as shown in FIG. 3, a bearing displacement d can be provided between the central bearing and peripheral bearings. The relative top points of the central and peripheral bearings defined by dimension d can be finely controlled to provide an ideal weight distribution of the cable reel load between the bearings. Surprisingly, the weight distribution between the bearings can be dramatically reduce the pulling force of the cable from the cable reel during payoff. For instance, in certain aspects the load of a cable reel can be distributed having a range from 30% to 80%, 40% to 75%, or 50% to 65% of the weight of the cable reel (and cable) supported by the central bearing, and the remainder distributed to the peripheral bearings. In other methods, the weight distribution can be at least 30%, at least 40%, at least 50%, at least 60%, at least 70%, or at least 80% on the central bearing.

Moreover, the respective vertical position (e.g., height) of the central bearings and peripheral bearings independently can be variable relative to the frame. In certain aspects, the vertical position of the peripheral bearings can be fixed, while the vertical position of the central bearing is variable. Alternatively, the vertical position of each peripheral bearing can be variable with respect to the frame. In certain aspects, the central bearing can be compressible over a vertical travel upon application of a load weight, and the peripheral bearings relatively or completely non-compressible. Such aspects allow the position of the plate relative to the plane defined by the top of the peripheral bearings to be variable between a loaded state and an unloaded state in respect to dimension d. Such variability can allow the loaded state of the cable reel payoff under differing loads to distribute the weight of the reel among the bearings optimally according to the weight of the reel, and variable based on the change in dimension d proportional to the weight of the reel.

Bearing displacement d may be best shown in the side view of FIG. 3, In certain aspects, dimension d the central bearing can be positioned above the plane defined by the top of peripheral bearings in a range from ⅛" to about 1" in an unloaded state. Upon loading a cable reel to the plate, the central bearing can compress to a maximum compression in any suitable range. In certain aspects, the central bearing can compress from ¼" to 2", such that the central bearing does not extend above the plane defined by the top of the peripheral bearings in a loaded state, and may even allow bearings to press above the plane defined by the top of the central bearing and into the bottom surface of the plate to form a channel therein, as described above. FIG. 3 provides a side view of the embodiment of FIG. 1, and dimension d showing the distance between the plane defined by the top of the peripheral bearings and the plane defined by the top of the central bearing (or alternatively the plane defined by the bottom surface of the plate, where such are coplanar).

In this manner, the central bearing may be positioned above (e.g., 1" above) the top plane of the peripheral bearings in an unloaded state, and be compressed to a position below (e.g., 1" below) the top plane of the peripheral bearings in a loaded state, and any gradient in between the two extremes. In this manner, the central bearing may bear at least 80%, at least 90% or 100% of the weight of the base plate in an unloaded state, and in any range above when loaded at capacity.

Figure 4:
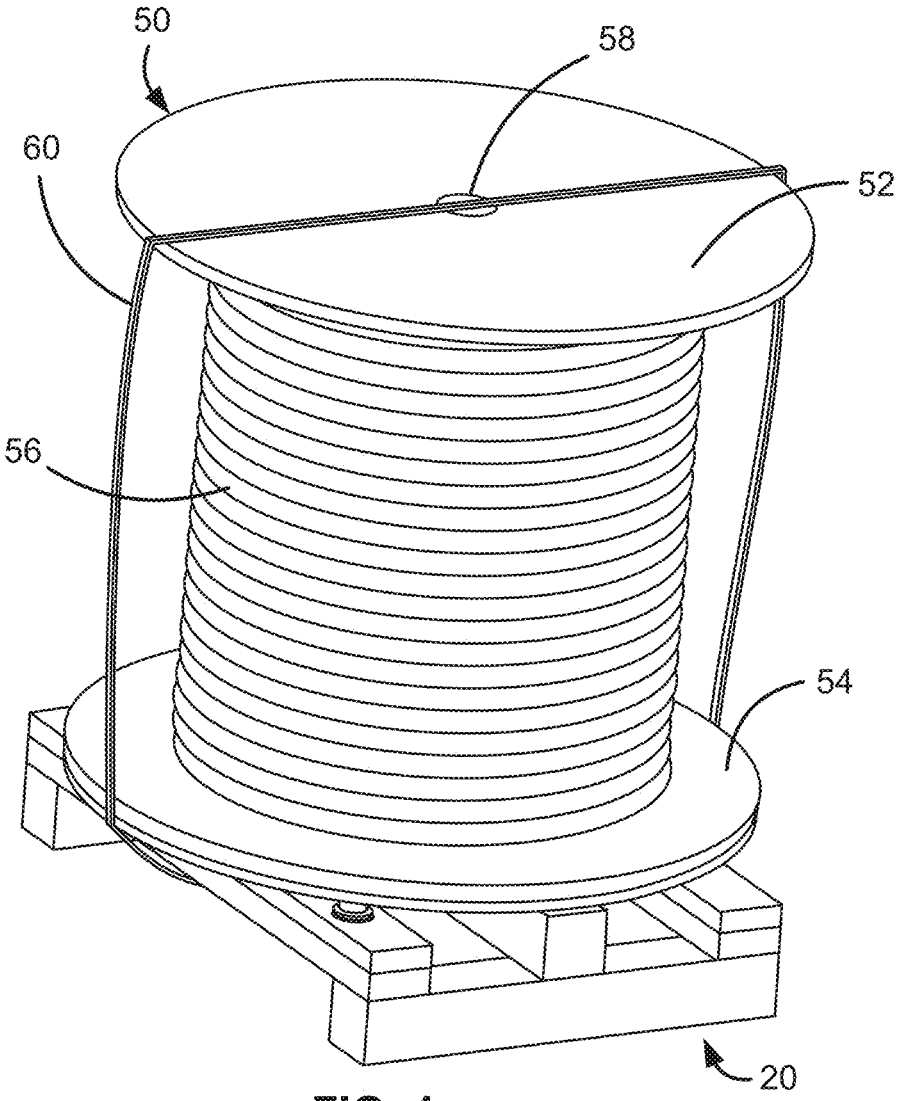
FIG. 4 depicts a second embodiment of a disposable cable payoff system of the present invention, preloaded with a cable reel and packaged for shipment.
Figure 5:
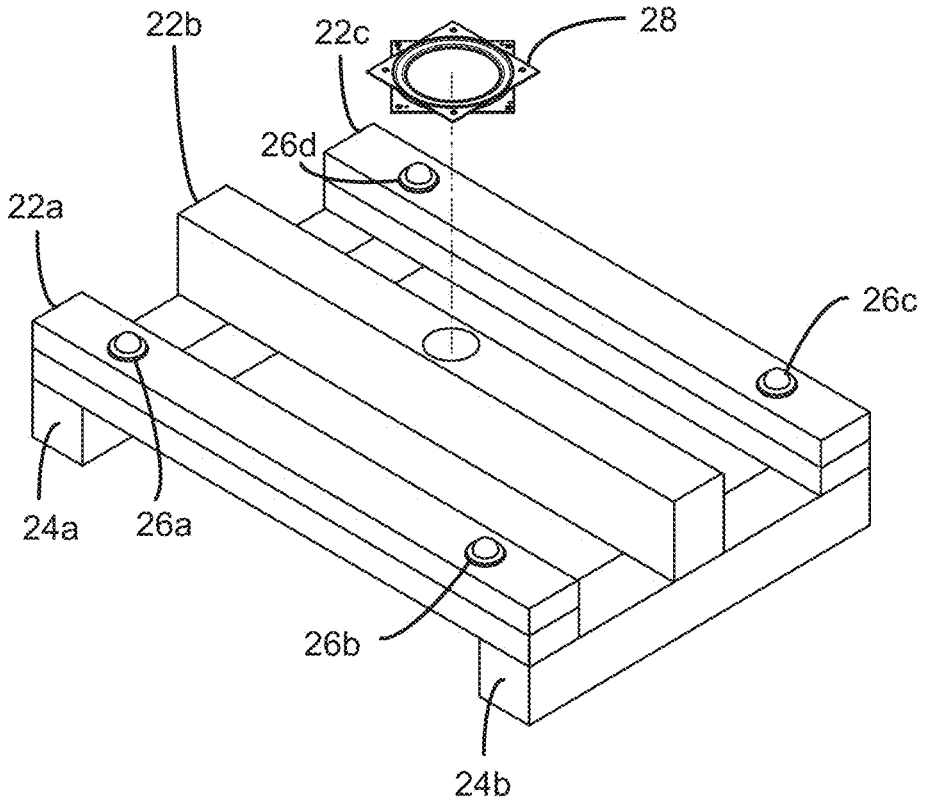
FIG. 5 depicts a portion of the disposable cable payoff of FIG. 4.

FIG. 5 shows the support frame and bearing arrangement of the cable payoff depicted in FIG. 4. As shown, the support frame comprises three top supports 22*a-c*, with outer supports 22*a* and 22*c* being positioned somewhat lower than the central support 22*b*. In contrast to the embodiment shown in FIG. 2, the peripheral bearings 26*a-d* are not recessed within the support, but rather provided directly on a pair of shorter supports (e.g., a 2×4 and 1×4 seamed together). In the aspect depicted by FIG. 5, the central bearing extends above the plane defined by the top of peripheral bearings 26*a-d* approximately ¼"+/−⅛".

In certain aspects, fasteners can be employed to connect individual supports of support frame 20. In certain aspects, fasteners can be used to secure one or more bearings to the support frame 20. For instance, in an embodiment, the central bearing may be attached to the support frame by a minimum number of bearings (e.g., 2, 3, or 4), whereas the peripheral bearings are simply placed within recesses within the support frame. Limiting the number of fasteners present in the disposable systems can aid deconstruction and separation of materials upon disposal. As shown in FIG. 1, each of the peripheral bearings and pintle are provided within recesses without fasteners. The base plate also can be provided against and ultimately supported by the bearings without fastening the base plate to the support frame. Similarly, a cable reel can be secured against the base plate and with the pintle extending within an axis of the cable reel without fasteners.

Limiting the total weight of the cable payoff system also can provide an advantage during shipping and disposal of the system. In certain aspects, the cable payoff system can weigh less than 100 lbs, less than 80 lbs, less than 75 lbs, less than 60 lbs, less than 50 lbs, or less than 35 lbs. In any of these aspects, a pulling force required to pay off cable from the system can be equal to or less than durable, reusable cable payoff systems as conventionally constructed, and any pulling force disclosed herein.

Surprisingly, it is found that embodiments described herein, using materials and constructions amenable to disposable systems, are able to perform acceptably for cable payoff during commercial use. In certain embodiments, the pulling force required to pay off the cable reel can be equal to, or in certain aspects less than, the pulling force required for cable payoff systems comprising fixed configurations and durable components such as a metal base plate. In certain aspects, the average pulling force can be less than 90%, less than 80% or less than 70% that of conventional cable payoff systems comprising a metal base plate, metal frame, metal pintle, or any combination thereof. In certain aspects, the pulling force required to pay off cable can be less than 100 lbf, less than 75 lbf, less than 50 lbf, less than 40 lbf, or less than 35 lbf. Pulling forces disclosed here can apply to cable reels having any weight disclosed above. In certain aspects, cable payoff systems disclosed herein can pay off a cable reel weighing more than 400 lbf with an average pulling force less than 75 lbf, less than 50 lbf, or less than 40 lbf.

Packaged disposable cable payoff systems are also disclosed herein, and generally can be any arrangement that provides a transportable, and storable arrangement of the payoff systems preloaded with a cable reel. Packaging disclosed herein can comprise a disposable cable payoff system as described herein, a cable reel loaded onto the disposable cable payoff system, and a band secured to the cable reel and configured to maintain the position of the cable on the cable reel during shipping and storage, but not interfere with cable payoff.

In certain aspects, packaging can comprise a single banding extending over the center of the cable reel and under the support base of the payoff system. As shown in FIG. 4, cable reel 50 is loaded onto payoff system 10, having a top flange 52 and bottom flange 54 adjacent the base plate and top flange 52. Banding 60 is applied to secure the cable reel 50 to the support frame 20 during transport and storage, and can be easily removed once the payoff system is positioned within the commercial bay for payoff of cable 56. As discussed above, cable reel 50 also comprises an axis 58 secured around the pintle (not shown) recessed within the center support of the support frame 20 (as shown in FIG. 1).

In certain aspects, a plurality of straps can be included to secure the cable reel during transport. In certain aspects, two bands traversing the space beneath the support can be installed against the bottom flange of the cable reel in a secured position. Such aspects may further comprise an addition center strap over the top flange of the cable reel as discussed above. In certain aspects, the support frame can have slots within any portion for accepting banding and preventing damage to the straps during transport, e.g., by the forks of a forklift. Fasteners (e.g., lag bolts) may also be used to alternatively secure the reel to the support frame during transport and storage, alone or in combination with banding arrangements as for any described herein. In certain aspects, a bolt may be secured to the center support through the bottom flange of the cable reel and the rotatable base plate. In such aspects, the bolts can be removed from the packaging once positioned within the warehouse bay, and prior to payoff. Bolts can then be replaced if the cable reel is needed to be moved from its initial position. Cable reel packaging are also contemplated having bolt holders to retain such bolts or fasteners to the support frame or any other position of the disposable cable payoff such that the bolts are easily accessible throughout the use of the cable reel payoff. As for other aspects, fasteners may be easily disassembled from the device and discarded, recycled, or reused once the cable reel has been completely payed off.

Figure 6:
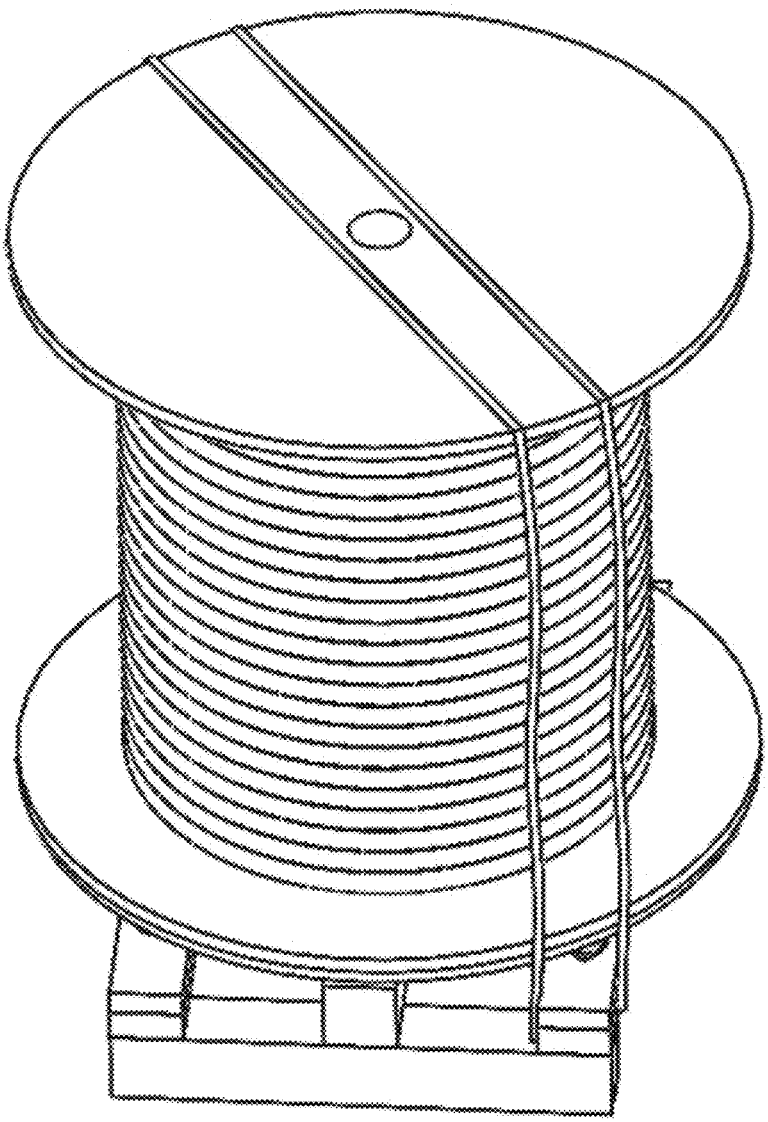
FIG. 6 depicts another embodiment of single-use packaging of a cable payoff system of the present invention.
Figure 7:
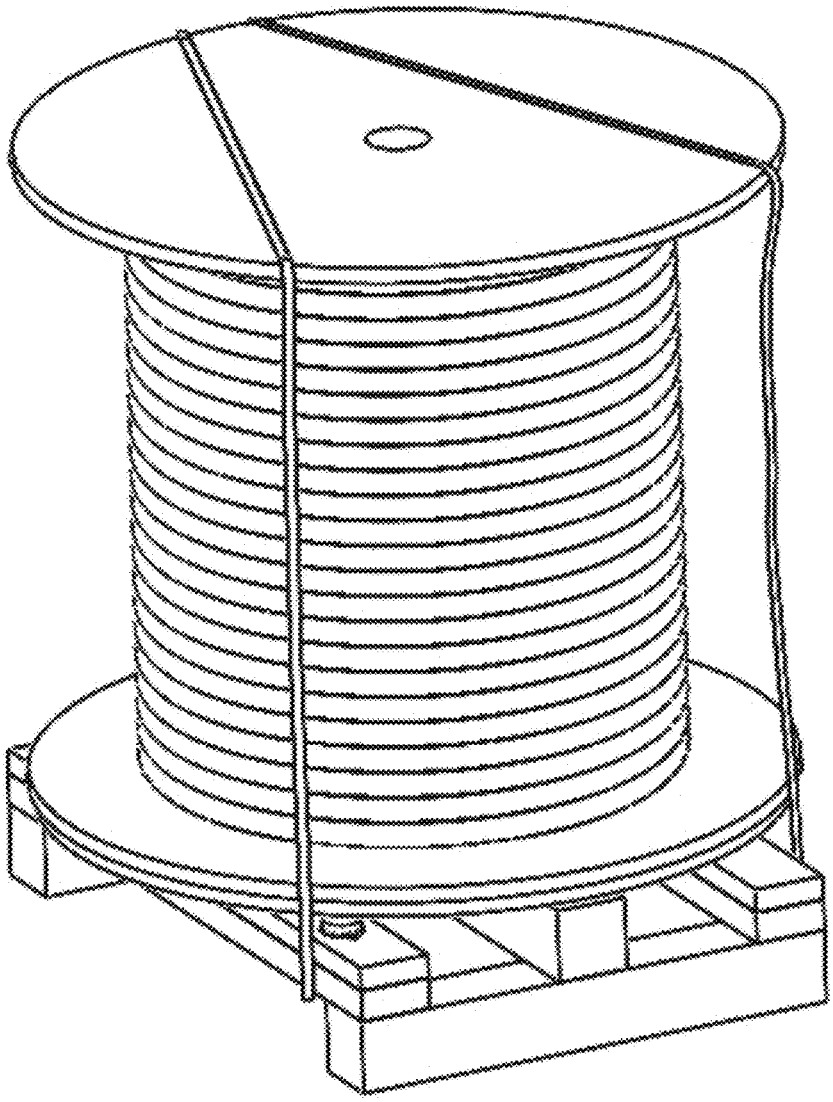
FIG. 7 depicts another embodiment of single-use packaging of a cable payoff system of the present invention.
Figure 8:
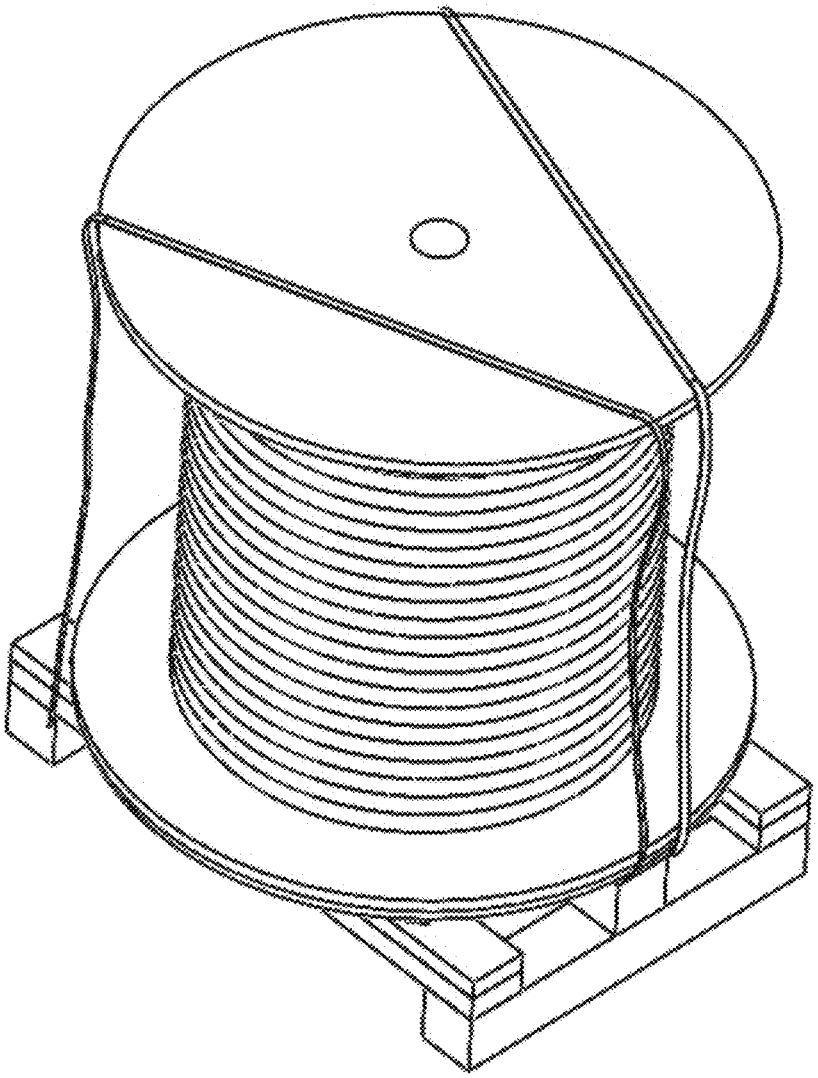
FIG. 8 presents an additional view of the embodiment depicted in FIG. 7.

FIGS. 6-8 provide additional examples of banding patterns. In FIGS. 6-8, a single continuous strap is banded over the top flange of the cable reel in two separate passes, and looped around a corner or edge of the support frame. In FIG. 6, an aspect is shown with the banding looped under opposing corners of the support frame and across the top flange in a parallel manner. FIGS. 7-8 depict views of an embodiment where the banding is looped under the central support on one side, and looped under the entire opposing edge of the support frame, as best shown in FIG. 8. In this manner, banding straps can be secured to the support frame without interfering with the use of forklifts in moving the packaged reel, preventing the banding from damage. Such bandings provide additional security to the package relative to embodiments such as shown in FIG. 4, which is secured laterally by only the pintle.

Packaging disclosed herein can further comprise any additional elements commonly employed for securing devices during shipping. For instance, the cable reel and payoff system may be shrink-wrapped to secure the preloaded systems prior to installation at a commercial bay. Packaging may further include cardboard packaging to indicate marketing or product features and characteristics. Further variations to packaging described above are also contemplated herein, as would be understood by those of skill in the art.

EXAMPLES

The disclosure is further illustrated by the following examples, which are not to be construed in any way as imposing limitations to the scope of this disclosure. Various other aspects, modifications, and equivalents thereof, which, after reading the description herein, may suggest themselves to one of ordinary skill in the art without departing from the spirit of the present disclosure or the scope of the appended claims.

Tests to determine the pulling resistance of the inventive payoffs disclosed herein were conducted according to the following procedure. A black plastic cable reel containing Southwire Alumaflex® 3c 4/0, 1c 2/0 compact aluminum cable was loaded onto the cable payoff system. The reel and cable combined weighed 570 lbs, separate from the payoff system. The commercial example payoff system weighed an additional 87 pounds, and payoff systems of Examples 1-4 each weighed approximately 51 pounds. A fiber optic cable puller was connected to the end of the cable on the reel and fitted with a load cell to record the pulling force, and the cable reel was secured in position. A force meter was attached at the connection between the cable and the cable puller, and force meter readings were recorded by a laptop at a rate of 10 readings per second. Roughly 800 data points were recorded for each example over a pull of 10 feet of cable. Each pull was conducted in triplicate. Descriptions of each cable payoff system are provided below, with results from each of the respective pulling tests summarized in Table 1.

Commercial Example (CE) A commercial, reusable payoff system constructed with a steel base plate and weighing was loaded with a cable reel as provided above. The commercial payoff system has a steel support frame base comprising four inverted caster wheels attached to the frame and configured to support the bottom face of the steel base plate. The steel base plate further comprises a cylindrical steel post secured to the top surface of the base plate. The support frame comprises two caster wheels for interacting with a ground surface, allowing the other side to be lifted and the device wheeled about when supported by the two support wheels. The commercial payoff system weighed 87 lbs.

Example 1—Cable Payoff System with Central Bearing Only

A first payoff system was constructed having a central 'lazy susan' bearing secured to the supports frame with no peripheral bearings. The base plate was a ¾" plywood circle, comprising a pintle secured directly to the top face of the base plate, and did not extend through and into the support frame. The base plate was secured by fasteners to the lazy susan bearing. The support frame consisted of two 2×4 at the edges of a ¾" plywood sheet.

Example 2—Cable Payoff with Peripheral Ball Transfer Bearings and Central Slip Ring A second payoff system comprises a multilayer support frame constructed of two 4×4 posts within a bottom layer and three 4×4 posts as an upper layer, the posts in each layer arranged perpendicularly. The pintle extends through the base plate, and into a recessed region within the central support of the top layer in the support frame. Four peripheral ball transfer bearings are placed within recesses in the upper layer of the support frame and arranged within a single concentric path about the pintle and central bearing, as depicted by FIG. 2. A central slip ring was positioned between the support frame and base plate as a central bearing.

Example 2B—Cable Payoff System with Lazy Susan Central Bearing

Example 2B was a modification to the payoff system of Example 2, wherein the central slip rings are replaced by a lazy susan bearing. A bottom portion of the lazy susan bearing is secured to the support frame, and the base plate rests on a top surface of the lazy susan bearings without fastening. Peripheral bearings are recessed within the support frame in order to accommodate the height difference between the lazy susan bearing. The embodiment shown in FIGS. 1-2 is representative of this example. The cable payoff system weighed 51 lbs.

Example 3—Cable Payoff System of Example 1, with Alternate Peripheral Bearing

A further embodiment of a cable payoff system was constructed identically to Example 1, with the exception that peripheral adhesive gliders were positioned between the adjacent surfaces of the support frame and the base plate and peripheral to the central lazy susan bearing.

Example 4—Cable Payoff System of Example 2, with Alternate Peripheral Bearing

A further embodiment of a cable payoff system was constructed identically to Example 2, with the exception that each ball transfer bearing was replaced with an adhesive glider.

TABLE I

Summary of results

| Pulling force (lbf) | CE | Ex. 1 | Ex. 2 | Ex. 2B | Ex. 3 | Ex. 4 |
|---|---|---|---|---|---|---|
| Average | 37 | 117 | 44.2 | 29 | 74.5 | 112.1 |
| Maximum | 52.8 | 150.8 | 107.8 | 64.9 | 92.0 | 143.1 |
| Minimum | 19.5 | 36.9 | 14.8 | 7.7 | 35.9 | 34.9 |
| Standard Deviation | 5.2 | 13 | 14.3 | 9.9 | 7.1 | 13.3 |

Results from each of the examples provided above are summarized within the table above below. Surprisingly, Examples 2 and 2B demonstrated an average pulling force comparable to the commercial example representing the permanent, reusable steel construction currently employed. Example 2 was able to achieve these results with a central slip ring positioned as the central bearing, and without recessed bearings such that the bearings supported the majority of the cable reel load during payoff. Example 2B reduced the average pulling force further by the addition of a lazy susan style central bearing as described above, even beyond the average pulling force of the commercial example. Example 2B also carried the advantage of being significantly lighter at 51 pounds, and easily deconstructable for disposal.

Additionally, and surprisingly, Example 2B also demonstrated that inclusion of a lazy susan bearing can drastically reduce the maximum pulling force compared to Example 2, and the reducing the minimum pulling force even below that observed for the commercial example lacking a central bearing and having heavier components. None of the Inventive Examples were conducted where a channel was preformed within the base plate. Accordingly, and without being bound by theory, it is contemplated that preforming a channel within the base plate may reduce standard deviation in each of Examples 1-4 disclosed herein.

What is claimed is:

1. A system for paying off cable from a cable reel, the system comprising:
- a support frame;
- a base plate;
- a central bearing having a first portion secured to the support frame, and a freely rotatable second portion configured to rotate relative to the first portion;
- a plurality of peripheral bearings secured to the support frame and positioned to contact and support the base plate during reel payoff; and
- a pintle configured to maintain the axial position of a cable reel relative to the support frame; wherein:
- the base plate comprises wood;
- the central bearing is a lazy susan bearing;
- the base plate rests on a top surface of the lazy susan bearing; and
- the system has a bearing displacement in a range from 0 to 1 inches when the system is in an unloaded state.

2. The system of claim 1, wherein a maximum pulling force required to payoff a 10-foot length of cable from a 570-lb reel at a rate of at least 1 foot per minute is less than 100 lbf.

3. The system of claim 1, wherein the minimum pulling force required during payoff of a 10-foot length of cable from a 570-lb reel at a rate of at least 1 foot per minute is less than 15 lbf.

4. The system of claim 1, wherein the base plate consists of wood.

5. The system of claim 1, wherein the average pulling force required to payoff a length of cable is not more than 125% that of an otherwise identical system comprising a base plate comprising metal.

6. The system of claim 1, wherein the base plate has:
- a substantially circular shape;
- a thickness in a range from 15/32 inches to 1¼ inches; and
- a diameter in a range from 18 to 48 inches.

7. The system of claim 1, wherein the second portion of the central bearing is secured to the base plate.

8. The system of claim 1, wherein the system has a bearing displacement in a range from ⅛ inches to 1 inches inch when the system is in an unloaded state.

9. The system of claim 8, wherein the bearing displacement in the unloaded state is in a range from ⅛ inches to ⅜ inches.

10. The system of claim 8, wherein the bearing displacement is variable between the unloaded state and a loaded state.

11. The system of claim 10, wherein the bearing displacement in the loaded state is in a range from −1 to 0 inches.

12. The system of claim 11, wherein the plurality of peripheral bearings forms a depression within the base plate when the bearing displacement is less than 0.

13. The system of claim 12, wherein the depression comprises a circular channel formed by paying off cable from the cable reel, the circular channel having a depth in a range from 1/16" to 1/2".

14. The system of claim 1, wherein the plurality of peripheral bearings consists of four ball transfer bearings.

15. The system of claim 1, wherein each of the plurality of peripheral bearings are positioned to form a concentric path in the base plate having a diameter in a range from 18 to 30 inches.

16. The system of claim 1, wherein the pintle is inserted within a bore of the support frame and extends through the base plate substantially perpendicular to the base plate.

17. The system of claim 1, further comprising a cable reel, the cable reel having a flange adjacent the base plate, and the pintle inserted within an axis of the cable reel.

18. The system of claim 17, wherein the cable reel has a weight in a range from 300 pounds to 800 pounds.

19. A method of providing the preloaded, disposable cable payoff system of claim 1 to a warehouse bay, the method comprising:

loading a cable reel onto a disposable reel payoff system to provide a preloaded cable reel payoff system; and shipping the preloaded cable payoff system to a commercial site; and installing the preloaded cable payoff system in a warehouse bay without requiring an on-site reel loading operation;

paying off a plurality of cable lengths from the cable reel;

discarding or recycling the disposable cable payoff system and cable reel.

20. A packaged, preloaded, cable reel payoff system comprising:

the system of claim 1 for paying off cable from a cable reel;

a cable reel having a flange positioned against the base plate and a reel axis encircling the pintle; and a band securing the cable reel to the support frame.

* * * * *